US006460395B1

(12) United States Patent
Courtney et al.

(10) Patent No.: US 6,460,395 B1
(45) Date of Patent: Oct. 8, 2002

(54) SYSTEM AND METHOD FOR BENDING A STRUCTURAL MEMBER

(75) Inventors: Brian K. Courtney; James C. White, both of Grand Prairie; Reginald W. Bechdolt, Bedford, all of TX (US)

(73) Assignee: Vought Aircraft Industries, Inc., Dallas, TX (US)

( * ) Notice: Subject to any disclaimer, the term of this patent is extended or adjusted under 35 U.S.C. 154(b) by 0 days.

(21) Appl. No.: 09/850,553

(22) Filed: May 7, 2001

(51) Int. Cl.[7] ..... B21D 7/02

(52) U.S. Cl. ..... 72/387; 72/298; 72/383

(58) Field of Search ..... 72/217, 295, 298, 72/387, 388, 383

(56) References Cited

U.S. PATENT DOCUMENTS

| | | | | | |
|---|---|---|---|---|---|
| 1,066,247 | A | * | 7/1913 | Brown | 72/383 |
| 2,884,987 | A | * | 5/1959 | Shaw, Jr. | 72/383 |
| 3,274,817 | A | * | 9/1966 | Anderson | 72/298 |
| 4,890,469 | A | * | 1/1990 | Dischler | 72/217 |
| 5,588,322 | A | * | 12/1996 | Passone | 72/298 |
| 6,012,320 | A | * | 1/2000 | Stepanenko et al. | 72/298 |

* cited by examiner

*Primary Examiner*—David Jones

(57) ABSTRACT

According to one embodiment of the invention, a system for bending a structural member includes a base, a pair of pivot plates rotationally coupled to the base, an actuator coupled between the pair of pivot plates, and a plurality of adjustable supports adjustably coupled to the pair of pivot plates. The adjustable supports are adjustable in a transverse direction, and are operable to bend the structural member through a rotation of the pivot plates.

18 Claims, 6 Drawing Sheets

SYSTEM AND METHOD FOR BENDING A STRUCTURAL MEMBER

TECHNICAL FIELD OF THE INVENTION

This invention relates generally to the field of structural fabrication and, more specifically, to a system and method for bending a structural member.

BACKGROUND OF THE INVENTION

Stringers are used extensively in the aeronautic industry. A stringer is essentially a structural member used in airfoil and fuselage structures. Because stringers are used in aircraft and other aerostructures, high-cost, low-density material, such as aluminum or titanium, are used to form stringers. Since stringers are typically formed with particular bend radii, manufacturers of stringers desire cost-effective methods of forming stringers that meet tight tolerances.

Stringer forming is typically a combination of an automated and a manual process, and the quality of the bending of stringers is highly dependent on the skill and artistry of the operator. An operator uses trial-and-error before arriving at the correct set-up for a particular machine, which wastes considerable time. This trial-and-error procedure also results in wasted material, depending on how many trial-and-error cycles the operator goes through. There are usually numerous cycles the operator goes through because of various factors in bending structural members. One such factor is springback, which refers to the tendency of a material to return to its original shape when a stress is removed.

Springback is compensated for by over-bending a structural member. Typically, an operator goes through at least a few, or sometimes many, trial-and-error cycles to determine the springback for a particular structural member with a particular cross-section. In addition, stringers used in aerostructures generally have a thin cross-section, which means the structural members are more susceptible to buckling, wrinkling, and crippling. These are other factors the operator cannot determine and many trial-and-error cycles need to be performed before arriving at the correct set-up for the bending machine.

Another problem in bending stringers is that many different shapes or cross-sections of stringers are utilized depending on the aerostructure for which the stringer is used. For example, stringers may have Z-sections, C-sections, H-sections, I-sections, etc. Therefore, if a new forming machine is built for each cross-section, then considerable time and money is wasted. Thus, manufacturers desire quick, easy, and efficient ways to bend various and numerous cross-sections of stringers.

SUMMARY OF THE INVENTION

In accordance with the present invention, a system and method for bending a structural member is provided that addresses disadvantages and problems associated with previously developed systems and methods.

According to one embodiment of the invention, a system for bending a structural member includes a base, a pair of pivot plates rotationally coupled to the base, an actuator coupled between the pair of pivot plates, and a plurality of adjustable supports adjustably coupled to the pair of pivot plates. The adjustable supports are adjustable in a transverse direction, and are operable to bend the structural member through a rotation of the pivot plates.

According to another embodiment of the invention, a method for bending a structural member includes determining a plurality of support locations along a longitudinal axis of the structural member, bearing an inner pair of adjustable supports on a first side of the structural member and bearing an outer pair of adjustable supports on a second side of the structural member such that the position of the inner pair and outer pair of adjustable supports substantially match the determined plurality of support locations, and displacing the adjustable supports to a predetermined position. The adjustable supports are adjustable in a transverse direction of the structural member.

Embodiments of the invention provide numerous technical advantages. For example, a technical advantage of one embodiment of the present invention is that trial-and-error in setting up a bending apparatus is performed by a finite element analysis instead of a human, thereby eliminating guesswork and re-work of non-conforming parts, which saves considerable time and money. Another technical advantage of one embodiment of the present invention is that rapidly adjustable supports are adaptable to multiple structural member cross-sections, which saves on tooling costs as well as valuable manufacturing time.

Other technical advantages are readily apparent to one skilled in the art from the following figures, descriptions, and claims.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION OF EXAMPLE EMBODIMENTS OF THE INVENTION

Example embodiments of the present invention and their advantages are best understood by referring now to FIGS. 1 through 7 of the drawings, in which like numerals refer to like parts.

Figure 1:
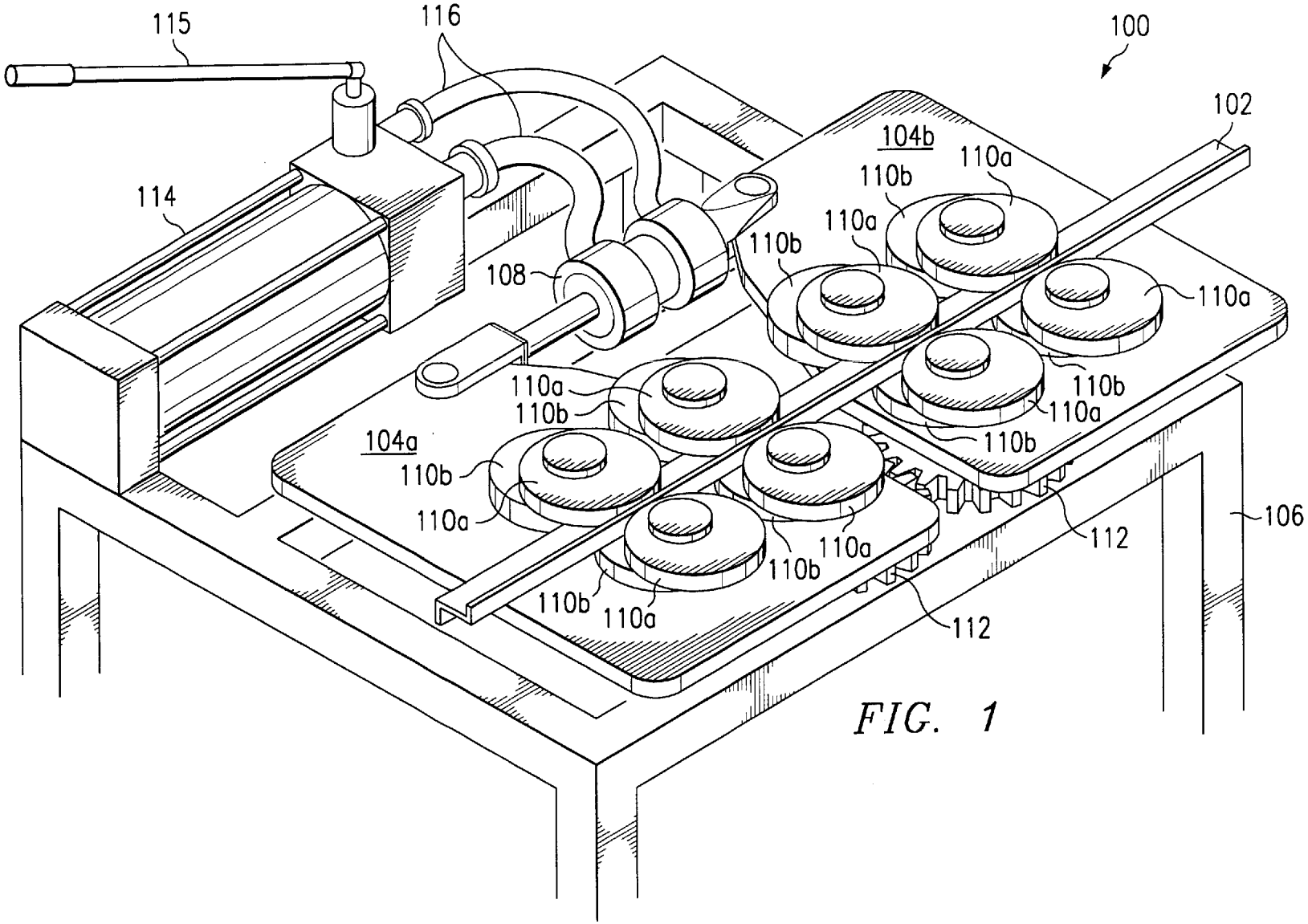
FIG. 1 is a perspective view illustrating a system for bending a structural member according to one embodiment of the present invention.

FIG. 1 is a perspective view illustrating a system 100 for bending a structural member 102 according to one embodiment of the present invention. System 100 includes a pair of pivot plates 104*a,* 104*b* rotationally coupled to a base 106, an actuator 108 coupled between pivot plates 104*a,* 104*b,* and a plurality of adjustable supports 110*a,* 110*b* adjustably coupled to pivot plates 104*a,* 104*b.*

In one embodiment, pivot plates 104*a,* 104*b* rotate via a pair of gears 112 disposed between pivot plates 104*a,* 104*b* and base 106 as illustrated in FIG. 1. In one embodiment, pivot plates 104*a,* 104*b* are horizontally-opposed steel plates with a configuration of that shown in FIG. 1; however, pivot plates 104*a,* 104*b* may be formed from other suitable materials and in other suitable configurations that facilitate their rotation for the purpose of bending structural member 102.

Gears 112, in one embodiment, are spur gears; however, other suitable gears may be used. In one particular embodiment, a ratio of gears 112 are such that pivot plates 104*a,* 104*b* rotate a substantially equal rotational distance. In this embodiment, a continuous radius is formed in structural member 102; however, pivot plates 104*a,* 104*b* may be mounted on gears 112 in a manner that facilitates either pivot plate 104*a* or pivot plate 104*b* rotating more or less than the other one, which results in more or less bending at one end of structural member 102 than at the other end.

Base 106 may comprise any suitable structural frame having any suitable configuration and being formed from any suitable material such that base 106 may support pivot plates 104*a,* 104*b*. Base 106 may also function to support actuator 108 and its associated equipment.

Actuator 108, in one embodiment, is a hydraulic actuator operable to push pivot plates 104*a,* 104*b* in opposite rotational directions; however, actuator 108 may be other suitable types of actuation devices, such as a pneumatic actuator or a mechanical or electromechanical device. In a particular embodiment, a closed-loop control of hydraulic solenoids could drive actuator 108 from a high-pressure fluid reservoir (not shown). Actuator 108 may include a cylinder 114 that houses hydraulic fluid, for example, and a handle 115 for pumping fluid into and out of actuator 108. Actuator 108 couples between pivot plates 104*a,* 104*b* and axially expands to facilitate the rotation of pivot plates 104*a,* 104*b* in opposite rotational directions so that adjustable supports 110*a,* 110*b* can bend structural member 102.

Adjustable supports 110*a,* 110*b* are operable to bend structural member 102 through rotation of pivot plates 104*a,* 104*b*. In one embodiment, adjustable supports 110*a,* 110*b* have curved bearing surfaces, such as the circularly shaped adjustable supports 110*a,* 110*b* as shown in FIG. 1. However, adjustable supports 110*a,* 110*b* may be formed in other suitable shapes. In addition, adjustable supports 110*a,* 110*b* may be formed from any material suitable for bending structural member 102, such as metal, plastic, or wood. Adjustable supports 110*a,* 110*b* are coupled to pivot plates 104*a,* 104*b* as described and shown below in conjunction with FIGS. 4–7.

In one embodiment of the present invention, adjustable supports 110*a,* 110*b* are adjustable in a longitudinal as well as a transverse direction. This adjustability allows system 100 to bend structural member 102 no matter what type of crosssection structural member 102 is formed in. One technical advantage of the present invention is that system 100 can bend structural members 102 having both symmetric and asymmetric cross-sections. Accordingly, adjustable supports 110*a,* 110*b* are operable to substantially conform to a cross-section of structural member 102. For example, as illustrated in FIG. 1, structural member 102 has a "Z-shaped" cross-section. However, structural member 102 may be formed with other cross-sections resembling various shapes, such as C-sections, I-sections, and L-sections. In addition, structural member 102 may be formed with a longitudinal tapering cross-section, which is sometimes used in aircraft design. Structural member 102 may be formed from any type of structural material having any suitable thickness.

Figure 2:
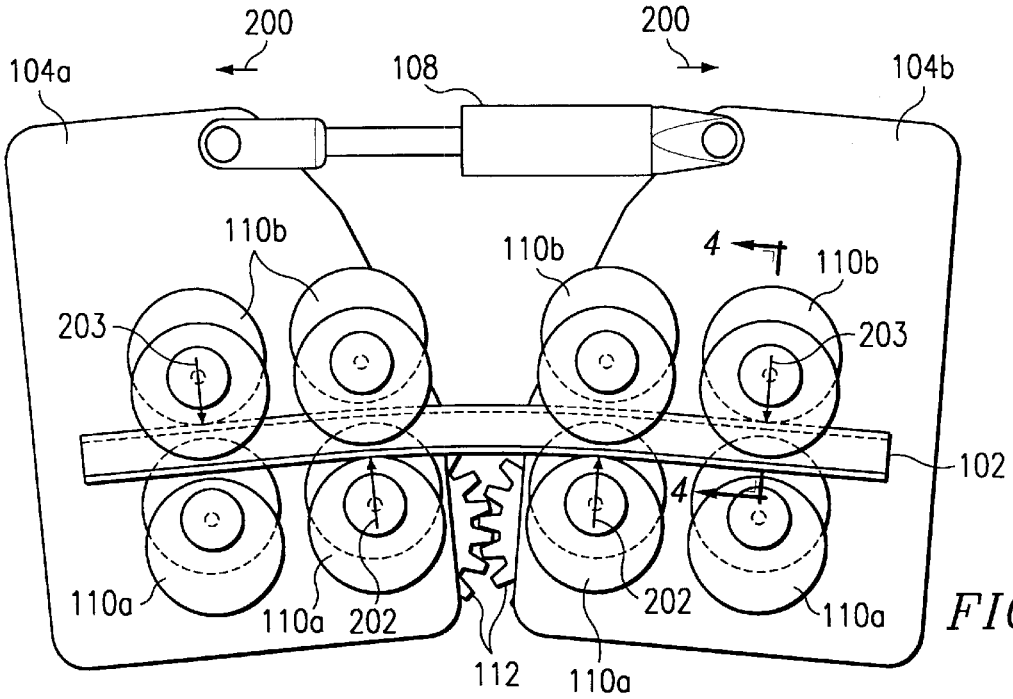
FIG. 2 is a partial plan view of the system of FIG. 1 showing a structural member being bent by a plurality of pairs of adjustable supports according to one embodiment of the present invention.

Structural member 102 is bent utilizing four-point bending through the use of adjustable supports 110*a,* 110*b* as illustrated best in FIG. 2.

FIG. 2 is a partial plan view of system 100 showing structural member 102 being bent by adjustable supports 110*a,* 110*b* according to one embodiment of the present invention. As illustrated by arrows 200, actuator 108 causes pivot plates 104*a* and 104*b* to rotate via gears 112, which causes two inner adjustable supports 110*a* to bear against one side of structural member 102 and two outer adjustable supports 110*b* to bear on the other side of structural member 102, as illustrated by arrows 202 and 203, respectively. The remaining adjustable supports 110*a,* 110*b* shown in FIG. 2, which are shown not to be bearing against structural member 102, may or may not bear against structural member 102 depending on whether lateral stability is needed to avoid any type of buckling, wrinkling, or crippling. Whether lateral stability is needed may be determined by any suitable computer analysis. Arrows 200 may point in a direction opposite to that illustrated in an embodiment where actuator 108 rotates pivot plates 104*a,* 104*b* in opposite directions to that described above. This means that structural member 102 is bent in the opposite direction of that shown in FIG. 2, which means that arrows 202 and 203 are "flipped over" to the other side of structural member 102.

Figure 3A:
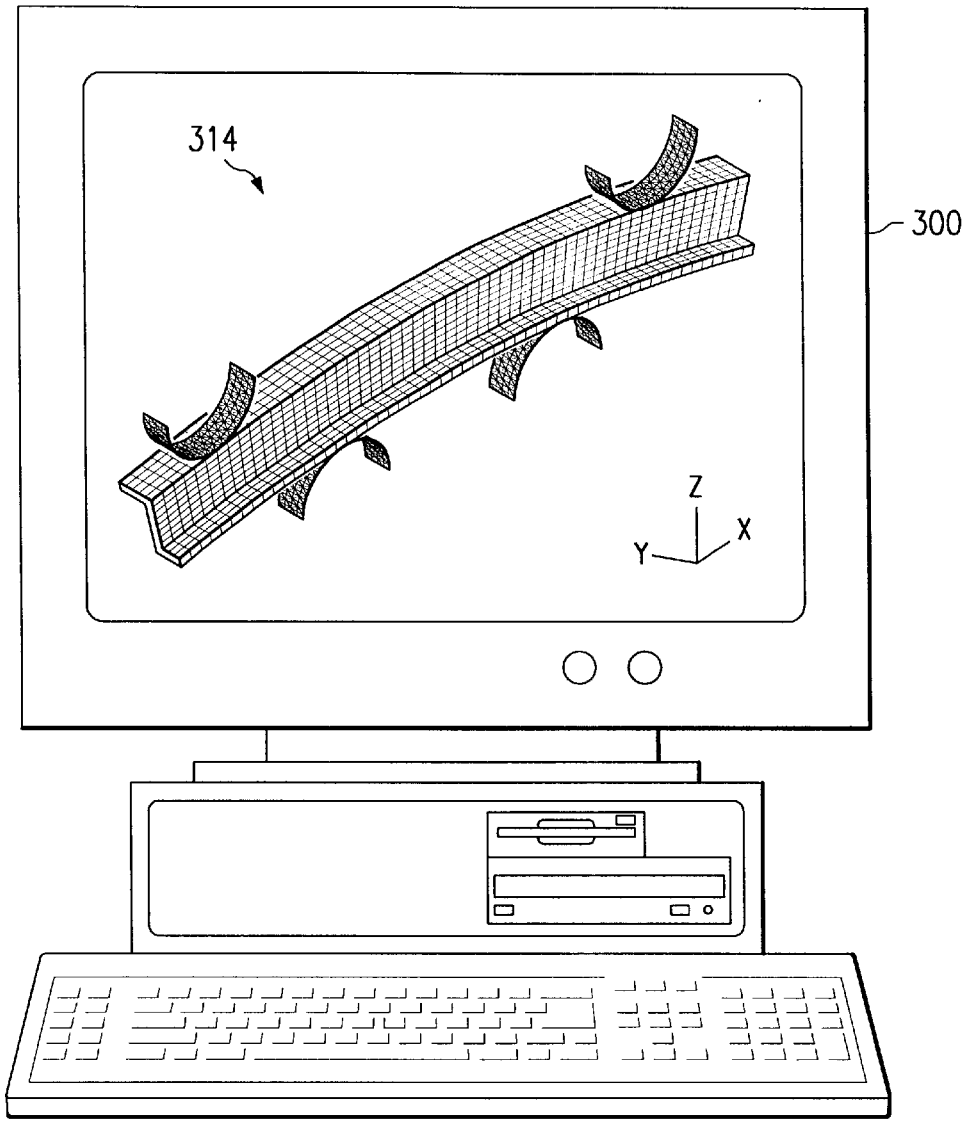
FIG. 3A is an elevation view of a computer illustrating a result of a finite element analysis according to one embodiment of the present invention.
Figure 3B:
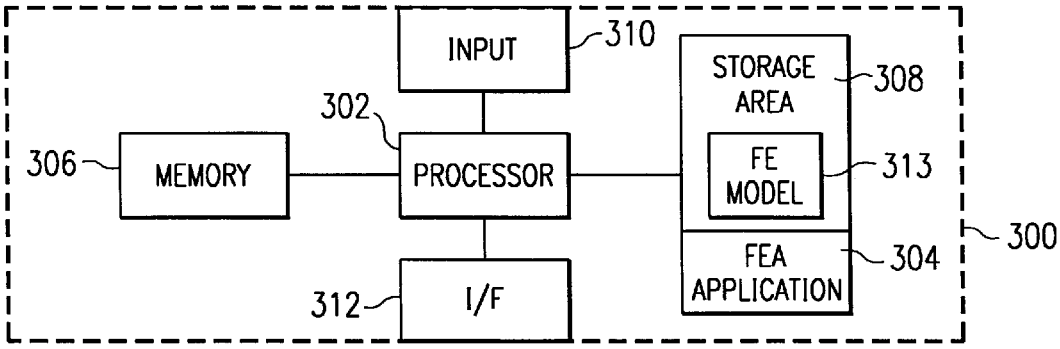
FIG. 3B is a block diagram of the computer of FIG. 3A.

To determine the longitudinal support locations of adjustable supports 110*a,* 110*b,* trial-and-error may be performed by an operator or, in one embodiment, a finite element analysis ("FEA") can be performed on a computer 300 as illustrated in FIGS. 3A and 3B.

FIG. 3A is an elevation view of computer 300 illustrating an FEA output 314 and FIG. 3B is a block diagram of computer 300 according to one embodiment of the present invention. Computer 300 is any suitable computer operable to execute an FEA application 304. Computer 300 includes a processor 302, FEA application 304, a memory 306, a storage area 308, an input 310, and an interface 312.

Processor 302 may comprise any suitable processing unit that executes logic. One of the functions of processor 302 is to retrieve FEA application 304 from storage area 308 so that an engineer or other qualified personnel can use FEA application 304 to determine longitudinal and transverse support locations for adjustable supports 110*a,* 110*b.*

FEA application 304 is a computer program or other application written in any suitable FEA language that is operable to determine responses of various structural members 102 to certain applied loads in certain locations. Finite element analysis applications are well known in the art of finite element analysis, one such example being ABAQUS from Hibbitt, Karlsson & Sorenson, Inc. However, other types of FEA applications 304 may be utilized.

Storage area 308 stores a finite element model 313. Finite element model 313 is an electronic description of the characteristics of structural member 102, adjustable supports 110*a,* 110*b,* and associated loading that is used by FEA application 304. According to this embodiment, finite element model 313 utilizes three non-linearities for describing structural member 102, adjustable supports 110*a,* 110*b,* and associated loading, and FEA model 313 is operable to incorporate these non-linearities. The first non-linearity is a material non-linearity that is based on a stress-strain curve of the material being bent. Another non-linearity is a displacement non-linearity, which is based on the large displacement theory well known in finite element analysis. The large displacement theory essentially rebuilds a stiffness matrix for structural member 102 after every increment of load is applied to structural member 102. The third non-linearity is a boundary constraint non-linearity, which sets certain boundary conditions for FEA model 313.

An output of FEA application 304, FEA output 314, is shown on a screen of computer 300 in FIG. 3A. FEA output 314 is the basis for determining longitudinal and transverse support locations for adjustable supports 110*a,* 110*b* as they are to be located approximate structural member 102. Generally, FEA application 304 may be used as follows. First, structural member 102 is modeled along with adjustable supports 110*a,* 110*b.* Next, the models of adjustable supports 110*a,* 110*b* are positioned along a longitudinal direction of structural member 102. Then the loading on structural member 102 is modeled, which essentially includes modeling a displacement for adjustable supports 110*a,* 110*b* (through a rotation of pivot plates 104*a,* 104*b*). These steps result in finite element model 313.

Thereafter, structural member 102 is yielded based on the modeled elements and loads. The loads are then released, and structural member 102 is allowed to springback before the final deflection is assessed. This includes determining the final shape and bend radius of structural member 102 with FEA application 304. If the final shape of structural member 102 according to FEA application 304 is the final shape that is desired, then FEA application 304 has performed its duty and system 100 can be utilized to bend structural member 102. However, if the final shape of structural member 102 is not the desired shape, then one or more parameters of FEA application 304 needs to be adjusted so as to obtain the desired shape of structural member 102. This may include changing the longitudinal and/or transverse locations of adjustable supports 110*a,* 110*b,* or adjusting the displacements of adjustable supports 110*a,* 110*b*. Any finite element analysis information regarding the bending of particular structural members 102 may be stored in memory 306 or storage area 308 for future use.

Memory 306 and storage area 308 may comprise a file, a stack, a database, or any other suitable organization of volatile or non-volatile memory. Memory 306 and storage area 308 may be random access memory, read only memory, CD-ROM, removable memory devices, or any other suitable devices that allow storage and/or retrieval of data. Memory 306 and storage area 308 are interchangeable and may perform the same functions. Input device 310 may be coupled to computer 300 for the purpose of inputting information, such as the parameters of FEA application 304. In one embodiment, input device 310 is a keyboard; however, input device 310 may take other forms, such as a mouse or stylus. In one embodiment, interface 312 is a CRT monitor; however, interface 312 may be other suitable types of computer interfaces, such as an LCD monitor.

For describing an operation of system 100 and how it is utilized to bend structural member 102, further details of how adjustable supports 110*a,* 110*b* are positioned and secured in place are described below in conjunction with FIGS. 4 through 6B.

Figure 4:
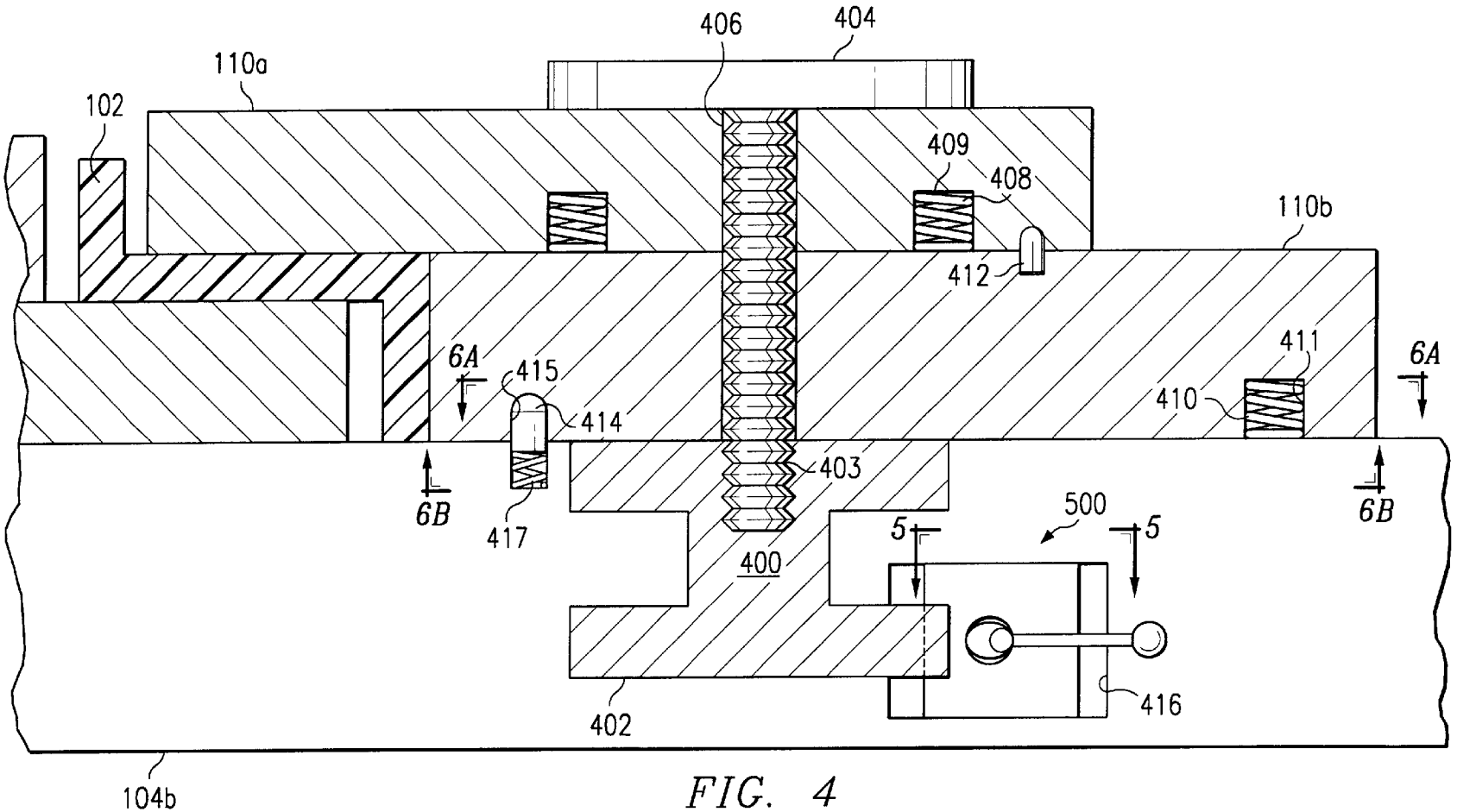
FIG. 4 is a cross-sectional view illustrating a system for positioning and anchoring a pair of adjustable supports according to one embodiment of the present invention.

FIG. 4 is a cross-sectional view illustrating a system for positioning and anchoring adjustable supports 110*a,* 110*b* according to one embodiment of the present invention. Only one embodiment for positioning and anchoring adjustable supports 110*a,* 110*b* is illustrated; however, other suitable arrangements for positioning and anchoring adjustable supports 110*a,* 110*b* may be utilized. In one embodiment, the system shown in FIG. 4 for positioning and anchoring adjustable supports 110*a,* 110*b* includes an anchor member 400 disposed within a channel 402, an anchoring wheel 404 having a threaded shaft 406, a first spring 408 disposed within a cavity 409, a second spring 410 disposed within a cavity 411, a static anchor pin 412, a retracting anchor pin 414, a third spring 417, and a longitudinal anchoring system 500.

In one embodiment, anchor member 400 is formed from the same material as pivot plates 104*a,* 104*b* in the shape of an I-section as that shown in FIG. 4; however, other suitable materials and other suitable shapes may be used. The function of anchor member 400 is to allow adjustable supports 110*a,* 110*b* to be longitudinally located along structural member 102 by using channel 402. To facilitate the longitudinal location of adjustable supports 110*a,* 110*b* anchor member 400 is provided with a threaded cavity 403 that is operable to accept threaded shaft 406 as shown in FIG. 4. Threaded cavity 403, in one embodiment, is female-threaded to accept male threads existing on a threaded shaft 406 of locking wheel 404. Locking wheel 404, in one embodiment, is a screw-like element that is operable to tighten down adjustable supports 110*a,* 110*b* to pivot plates 104*a,* 104*b.*

For positioning adjustable supports 110*a,* 110*b* transversely, eccentric holes are provided in adjustable supports 110*a,* 110*b,* which are preferably the same holes as described above. The eccentricity of these holes facilitates transversely positioning adjustable supports 110*a,* 110*b* by rotating adjustable supports 110*a,* 110*b* around threaded shaft 406. To secure adjustable supports 110*a,* 110*b* in their respective rotational positions, springs 408 and 410 work in conjunction with anchor pins 412 and 414, respectively, as described more fully below.

First spring 408 and second spring 410, in one embodiment, are helical springs; however, other suitable springs may be used. In one embodiment, first spring 408 is axially weaker than second spring 410 to allow adjustable support 110*a* to compress and engage one or more static anchor pins 412 before second spring 410 begins to compress so that adjustable support 110*b* engages one or more retracting anchor pins 414. This progressive engagement allows adjustable support 110*a* to be locked in place while adjustable support 110*b* is free to rotate. Typically, a plurality of first and second springs 408, 410 are distributed around each of adjustable supports 110*a,* 110*b* so that first and second springs 408, 410 can compress and engage as described.

In one embodiment, static anchor pins 412 and retracting anchor pins 414 are small, structural pins having rounded heads that are formed from any suitable material and are operable to engage small cavities or grooves in the bottom of adjustable supports 110*a,* 110*b*. Retracting anchor pin 414 may also have third spring 417 disposed below retracting anchor pin 414 and in a cavity existing in pivot plate 104*a,* 104*b*. In this way, if there is a plurality of retracting anchor pins 414 that are being utilized then only one retracting anchor pin 414 needs to engage a cavity or groove on the lower surface of lower adjustable support 110. The use of third springs 417 reduces the amount of cavities and/or grooves on the lower surface of adjustable support 110*b*. Further details and description of anchor pins 412 and 414 are described more fully below in conjunction with FIGS. 6A and 6B.

For longitudinally securing anchor 400 in pivot plates 104*a,* 104*b,* longitudinal anchoring system 500 may be employed in a cavity 416 as shown in FIG. 4. The details of longitudinal anchoring system 500 are described below in conjunction with FIG. 5.

Figure 5:
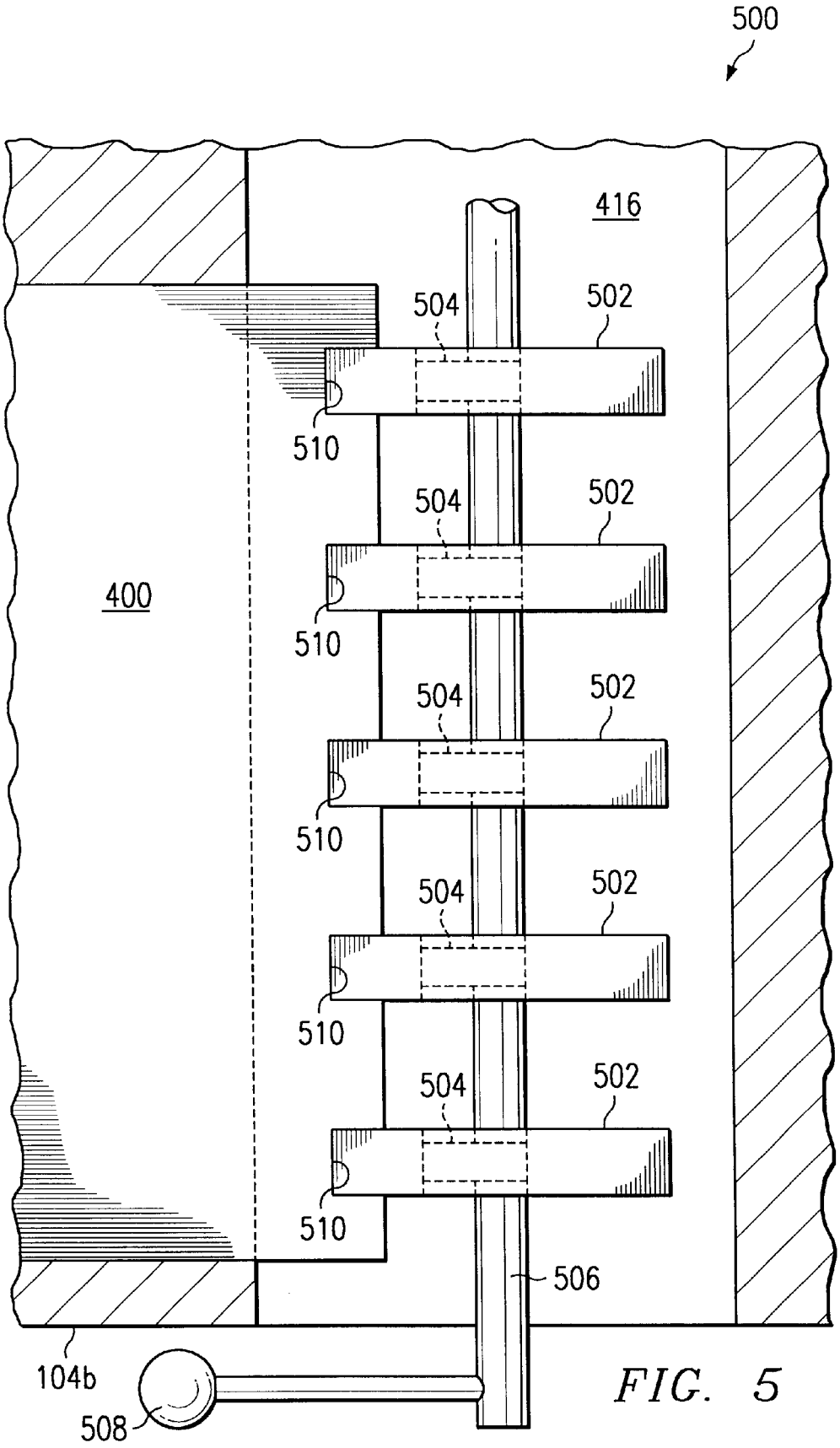
FIG. 5 is a partial plan view showing further details of longitudinally anchoring a pair of adjustable supports according to one embodiment of the present invention.

FIG. 5 is a partial plan view showing details of longitudinal anchoring system 500 according to one embodiment of the present invention. The view shown in FIG. 5 is a plan view from the inside of channel 416 looking down upon longitudinal anchoring system 500. Longitudinal anchoring system 500 includes a plurality of engaging plates 502 that selectively engage a plurality of notches 510 existing in anchor 400. Once the longitudinal location of adjustable supports 110*a,* 110*b* are determined, then longitudinal anchoring system 500 performs its function and causes engaging plates 502 to engage notches 510. This selective engagement is accomplished with a cam-type system. A plurality of cams 504 exist along a shaft 506 of longitudinal anchoring system 500 as shown in FIG. 5. A handle 508 causes engaging plates 502 to selectively engage and disengage notches 510 by turning handle 508 approximately 180 degrees. One or any number of engaging plates 502 and notches 510 may be employed.

Figure 6A:
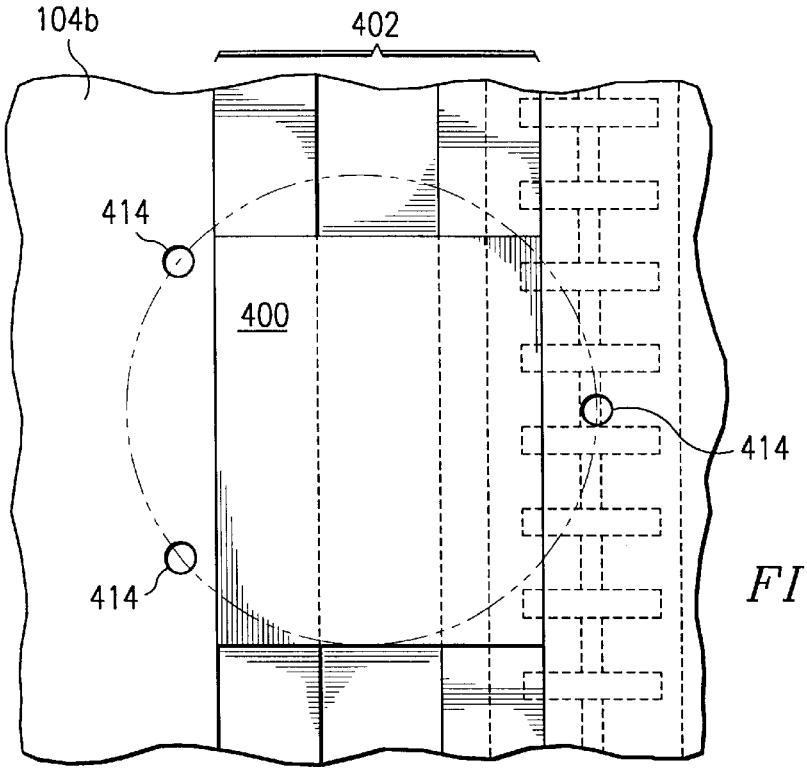
FIG. 6A is partial plan view showing three retracting anchor pins for laterally positioning and rotationally anchoring an adjustable support according to one embodiment of the present invention.
Figure 6B:
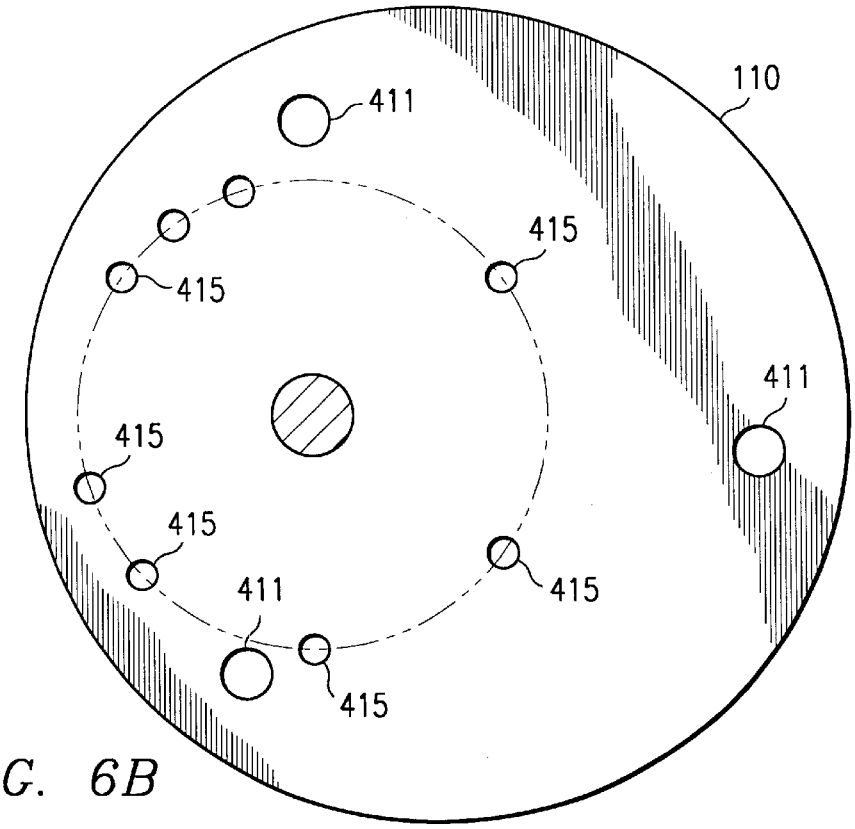
FIG. 6B is a bottom view of an adjustable support showing the layout of holes for accepting anchor pins or separation springs according to one embodiment of the present invention.

FIGS. 6A and 6B are partial plan views illustrating how adjustable support 110*b* (FIG. 4) is transversely positioned and rotationally anchored according to one embodiment of the present invention. Adjustable support 110*a* (FIG. 4) is transversely positioned and rotationally anchored in a similar manner to that shown in FIG. 6A. As illustrated, retracting anchor pins 414 exist within cavities formed in pivot plates 104*a,* 104*b*. The plurality of retracting anchor pins 414 are spaced a predetermined distance apart along a predetermined radius. This radius matches the radius of cavities 415 that are formed in the bottom surface of adjustable support 110*b* as shown in FIG. 6B. Cavities 415 are spaced such that an engagement of one or more retracting anchor pins 414 with cavities 415 work in conjunction with one another to accomplish a vernier adjustment of adjustable support 110*b*. This vernier adjustment allows very fine transverse positioning of adjustable support 110*b* through its rotational motion while keeping the number of retracting anchor pins 414 and cavities 415 to a minimum. As mentioned, the positioning and anchoring of adjustable support 110*a* is similar except that static anchor pins 412 are used instead of retracting anchor pins 414. Static anchor pins 412 are coupled to the upper surface of adjustable support 110*b* and static anchor pins 412 match up with a plurality of holes and/or grooves formed in the bottom surface of adjustable support 110*a*.

Also shown in FIG. 6B are cavities 411 that accept second springs 410, which were described above in conjunction with FIG. 4. As mentioned previously, cavities 411 are preferably distributed on the lower surface of adjustable support 110*b* so that they can perform their desired function as described above. Similarly, cavities 409 exist in the lower surface of adjustable support 110*a* for accepting first springs 408, which were described above in conjunction with FIG. 4.

Figure 7:
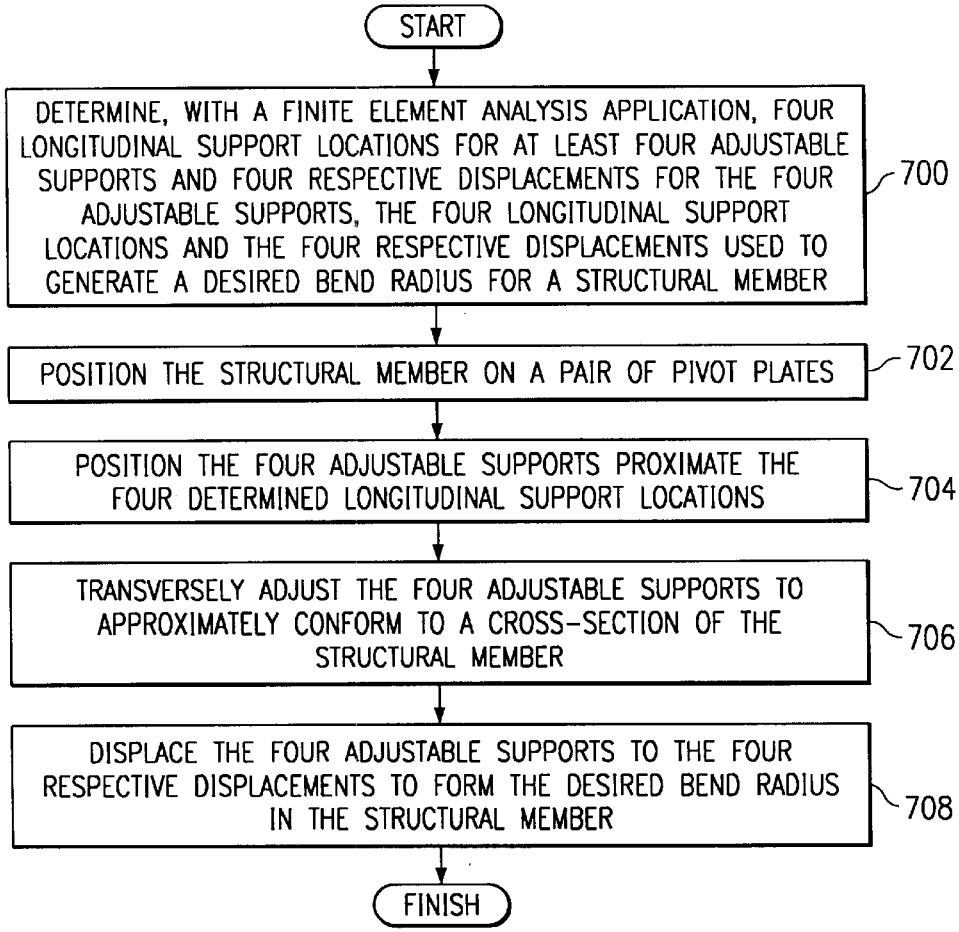
FIG. 7 is a flowchart demonstrating one method for bending a structural member in accordance with the present invention.

FIG. 7 is a flowchart demonstrating one method for bending structural member 102 in accordance with the present invention. At step 700, four longitudinal support locations for at least four adjustable supports 110*a,* 110*b,* and four respective displacements for adjustable supports 110*a,* 110*b,* are determined with FEA application 304, as described above. The four longitudinal support locations and the four respective displacements are used to generate a desired bend radius for structural 102. Structural member 102 is positioned on pivot plates 104*a,* 104*b* at step 702, and adjustable supports 110*a,* 110*b* are positioned proximate the determined longitudinal support locations at step 704. Adjustable supports 110*a,* 110*b* are then transversely adjusted to approximately conform to a cross-section of structural member 102 at step 706. At step 708, adjustable supports 110*a,* 110*b* are displaced to their respective displacements to form the desired bend radius in structural member 102, thereby ending one method for bending structural member 102 in accordance with the teachings of the present invention.

Although embodiments of the invention and their advantages are described in detail, a person skilled in the art could make various alternations, additions, and omissions without departing from the spirit and scope of the present invention as defined by the appended claims.

What is claimed is:

1. A system for bending a structural member, comprising:

a base;

a pair of pivot plates rotationally coupled to the base;

an actuator coupled between the pair of pivot plates;

a plurality of adjustable supports adjustably coupled to the pair of pivot plates, the adjustable supports adjustable in a transverse direction and adjustable in a longitudinal direction; and wherein the adjustable supports are operable to bend the structural member through a rotation of the pivot plates.

2. The system of claim 1, further comprising a finite element analysis application operable to determine a plurality of longitudinal support locations for the adjustable supports.

3. The system of claim 2, wherein the actuator rotates one of the pivot plates in a clockwise direction and the other pivot plate in a counter-clockwise direction such that each pivot plate is rotated a substantially equal rotational distance.

4. The system of claim 1, wherein the adjustable supports are operable to substantially conform to a cross-section of the structural member.

5. The system of claim 4, wherein the cross-section is asymmetric.

6. The system of claim 1, wherein the adjustable supports have curved bearing surfaces.

7. A system for bending a structural member, comprising:

a base;

a pair of pivot plates rotationally coupled to the base;

an actuator coupled between the pair of pivot plates;

a plurality of adjustable supports adjustably coupled to the pair of pivot plates, the adjustable supports adjustable in a transverse direction;

wherein the adjustable supports are operable to bend the structural member through a rotation of the pivot plates; and wherein the plurality of adjustable supports comprises at least four pairs of adjustable supports, two pairs of inner adjustable supports engaged with a first side of the structural member and two pairs of outer adjustable supports engaged with a second side of the structural member, each pair of adjustable supports eccentrically coupled to the pair of pivot plates.

8. A method for bending a structural member, the method comprising:

determining a plurality of support locations along a longitudinal axis of the structural member with a finite element analysis application.

bearing an inner pair of adjustable supports on a first side of the structural member and bearing an outer pair of adjustable supports on a second side of the structural member such that the position of the inner pair and outer pair of adjustable supports substantially match the determined plurality of support locations, the adjustable supports adjustable in a transverse direction of the structural member; and displacing the adjustable supports to a predetermined position.

9. The method of claim 8, wherein determining the support locations with a finite element analysis application comprises:

modeling the structural member to obtain a structural member model;

modeling the adjustable supports to obtain adjustable support models;

modeling the position of the adjustable support models proximate the structural member model at the support locations;

displacing the adjustable support models;

yielding the structural member model;

releasing the adjustable support models;

allowing the structural member model to springback; and assessing a final shape of the structural member model.

10. The method of claim 9, further comprising iterating at least one parameter of the finite element analysis application selected from the group consisting of the support locations and the displacing of the adjustable support models.

11. The method of claim 8, wherein bearing the inner pair of adjustable supports on the first side of the structural member and bearing the outer pair of adjustable supports on the second side of the structural member such that the position of the inner pair and outer pair of adjustable supports substantially match the determined plurality of support locations further comprises adjusting the adjustable supports to approximately conform to a cross-section of the structural member.

12. The method of claim 11, wherein adjusting the adjustable supports to approximately conform to the cross-section of the structural member comprises adjusting the adjustable supports to approximately conform to an asymmetric cross-section of the structural member.

13. A method for bending a structural member, the method comprising:

determining a plurality of support locations along a longitudinal axis of the structural member;

bearing an inner pair of adjustable supports on a first side of the structural member and bearing an outer pair of adjustable supports on a second side of the structural member such that the position of the inner pair and outer pair of adjustable supports substantially match the determined plurality of support locations, the adjustable supports adjustable in a transverse direction of the structural member;

eccentrically securing a first pair of adjustable supports to a first rotatable pivot plate;

eccentrically securing a second pair of adjustable supports to a second rotatable pivot plate; and rotating the first and second pivot plates in opposite directions.

14. A method for bending a structural member, the method comprising:

determining, with a finite element analysis application, four longitudinal support locations for at least four adjustable supports and four respective displacements for the four adjustable supports, the four longitudinal support locations and the four respective displacements used to generate a desired bend radius for the structural member;

positioning the structural member on a pair of pivot plates;

positioning the four adjustable supports proximate the four determined longitudinal support locations;

transversely adjusting the four adjustable supports to approximately conform to a cross-section of the structural member; and displacing the four adjustable supports to the four respective displacements to form the desired bend radius in the structural member.

15. The method of claim 14, wherein transversely adjusting the four adjustable supports to approximately conform to the cross-section of the structural member comprises transversely adjusting the four adjustable supports to approximately conform to an asymmetric cross-section of the structural member.

16. The method of claim 14, wherein determining, with the finite element analysis application, the four longitudinal support locations for the four adjustable supports and the four respective displacements for the four adjustable supports comprises:

modeling the structural member to obtain a structural member model;

modeling the adjustable supports to obtain adjustable support models;

modeling the position of the four adjustable support models proximate the structural member model at the four longitudinal support locations;

displacing the adjustable support models;

yielding the structural member model;

releasing the four adjustable support models;

allowing the structural member model to springback; and assessing a final shape of the structural member model.

17. The method of claim 16, wherein determining, with the finite element analysis application, the four longitudinal support locations for the four adjustable supports and the four respective displacements for the four adjustable supports comprises iterating at least one parameter of the finite element analysis application until the final bend radius is determined.

18. The method of claim 14, wherein displacing the four adjustable supports comprises:

eccentrically securing a first pair of adjustable supports to a first rotatable pivot plate;

eccentrically securing a second pair of adjustable supports to a second rotatable pivot plate; and rotating the first and second rotatable pivot plates in unison with a pair of meshing gears.

* * * * *